US007992726B2

(12) United States Patent
Goehring

(10) Patent No.: US 7,992,726 B2
(45) Date of Patent: Aug. 9, 2011

(54) SPACE SAVING MANUAL SHELF MANAGEMENT SYSTEM

(75) Inventor: William R. Goehring, Wexford, PA (US)

(73) Assignee: Shelf Advance, Inc., Wexford, PA (US)

( * ) Notice: Subject to any disclaimer, the term of this patent is extended or adjusted under 35 U.S.C. 154(b) by 266 days.

(21) Appl. No.: 12/238,847

(22) Filed: Sep. 26, 2008

(65) Prior Publication Data

US 2009/0084745 A1 Apr. 2, 2009

Related U.S. Application Data

(60) Provisional application No. 60/975,632, filed on Sep. 27, 2007, provisional application No. 61/032,673, filed on Feb. 29, 2008.

(51) Int. Cl.
*A47F 1/04* (2006.01)

(52) U.S. Cl. ..... 211/59.2; 211/184

(58) Field of Classification Search ..... 211/59.2, 211/59.3, 59.4, 74, 75, 34, 175, 184; 220/8; 206/217, 427, 557; 108/60, 61
See application file for complete search history.

(56) References Cited

U.S. PATENT DOCUMENTS 1,702,987 A 2/1929 Wilson
1,703,987 A 3/1929 Butler
1,708,407 A 4/1929 Arnold
1,714,266 A * 5/1929 Johnson ..... 220/8
1,910,046 A 5/1933 Pascoe
2,079,754 A 5/1937 Waxgiser
2,098,844 A 11/1937 Waxgiser
2,555,102 A * 5/1951 Anderson ..... 206/202
2,652,154 A 9/1953 Stevens
2,980,259 A 4/1961 Fowlds
3,028,014 A 4/1962 Southwick
3,083,067 A 3/1963 Vos et al.
3,110,402 A 11/1963 Mogulescu
3,134,499 A * 5/1964 Johnson ..... 220/8
3,224,594 A * 12/1965 Schweitzer ..... 211/74
3,232,439 A * 2/1966 Dahl, Jr. ..... 211/10
3,357,597 A 12/1967 Groff
3,887,102 A * 6/1975 Earley ..... 220/8
4,042,096 A 8/1977 Smith
4,300,693 A 11/1981 Spamer
(Continued)

FOREIGN PATENT DOCUMENTS

JP 03049906 U 6/1998

*Primary Examiner* — Darnell M Jayne
*Assistant Examiner* — Patrick Hawn
(74) *Attorney, Agent, or Firm* — Blynn L. Shideler; Krisanne Shideler; BLK Law Group

(57) ABSTRACT

A manual open bottom shelf allocation and management system for allocating shelf space among rows of products and for moving the rows of products toward the front of the shelf includes a plurality of adjacent shelf allocating and managing units. Each unit includes a pair of side dividers extending away from a front to a backstop defining an open bottom, wherein at least one row of products may be positioned on the shelf between the side dividers and wherein the side dividers provide for substantive lateral support for the product. Each unit is manually movable between the front and the back of the shelf and is adapted to advance at least one row of products toward the front of the shelf. The side dividers of two adjacent units may be in vertical alignment with one another.

17 Claims, 8 Drawing Sheets

U.S. PATENT DOCUMENTS 4,724,968 A 2/1988 Wombacher
4,729,481 A 3/1988 Hawkinson et al.
4,730,741 A 3/1988 Jackle et al.
4,762,236 A 8/1988 Jackle, III et al.
4,768,659 A 9/1988 Merl
4,785,945 A 11/1988 Rowse et al.
4,830,201 A 5/1989 Breslow
4,836,390 A 6/1989 Polvere
4,901,869 A 2/1990 Hawkinson et al.
4,907,707 A 3/1990 Crum
5,012,936 A 5/1991 Crum
5,016,772 A * 5/1991 Wilk ..... 220/8
5,069,349 A 12/1991 Wear et al.
5,111,942 A 5/1992 Bernardin
5,123,546 A 6/1992 Crum
5,160,051 A 11/1992 Bustos
5,197,610 A 3/1993 Bustos
5,232,102 A * 8/1993 Ozawa ..... 211/49.1
5,240,126 A 8/1993 Foster et al.
5,265,738 A * 11/1993 Yablans et al. ..... 211/59.3
5,361,895 A * 11/1994 Wilson et al. ..... 229/101
5,411,146 A 5/1995 Jarecki et al.
5,413,229 A 5/1995 Zuberbuhler et al.
5,450,969 A 9/1995 Johnson et al.
5,458,248 A * 10/1995 Alain ..... 211/175
5,469,976 A 11/1995 Burchell
5,542,552 A 8/1996 Yablans et al.
5,638,963 A 6/1997 Finnelly et al.
5,645,176 A * 7/1997 Jay ..... 211/59.2
5,676,262 A * 10/1997 Justice et al. ..... 211/71.01
5,904,256 A * 5/1999 Jay ..... 211/59.2
5,992,652 A 11/1999 Springs
6,082,556 A 7/2000 Primiano et al.
6,105,791 A 8/2000 Chalson et al.
6,129,218 A 10/2000 Henry et al.
6,142,316 A * 11/2000 Harbour et al. ..... 211/59.2
6,155,438 A 12/2000 Close
6,227,386 B1 5/2001 Close
6,237,784 B1 * 5/2001 Primiano ..... 211/59.2
6,273,276 B1 8/2001 Upton et al.
6,357,606 B1 3/2002 Henry
6,375,015 B1 4/2002 Wingate
6,382,431 B1 5/2002 Burke
6,484,891 B2 11/2002 Burke
6,527,127 B2 3/2003 Dumontet
D472,411 S 4/2003 Burke
6,719,151 B2 4/2004 Close
6,772,888 B2 8/2004 Burke
6,823,997 B2 11/2004 Linden et al.
6,886,700 B2 5/2005 Nagel
6,889,854 B2 6/2005 Burke
6,923,330 B1 8/2005 Nagel
6,991,116 B2 1/2006 Johnson et al.
7,063,217 B2 6/2006 Burke
7,086,541 B2 8/2006 Robertson
7,124,897 B2 10/2006 Bustos
7,168,579 B2 1/2007 Richter et al.
7,464,827 B2 * 12/2008 Meissen ..... 220/8
2001/0002658 A1 * 6/2001 Parham ..... 211/59.2
2003/0217980 A1 * 11/2003 Johnson et al. ..... 211/59.3
2004/0178158 A1 9/2004 Close
2005/0161413 A1 * 7/2005 Close ..... 211/51
2005/0189310 A1 * 9/2005 Richter et al. ..... 211/59.3
2006/0283819 A1 * 12/2006 Larsen et al. ..... 211/59.2

* cited by examiner

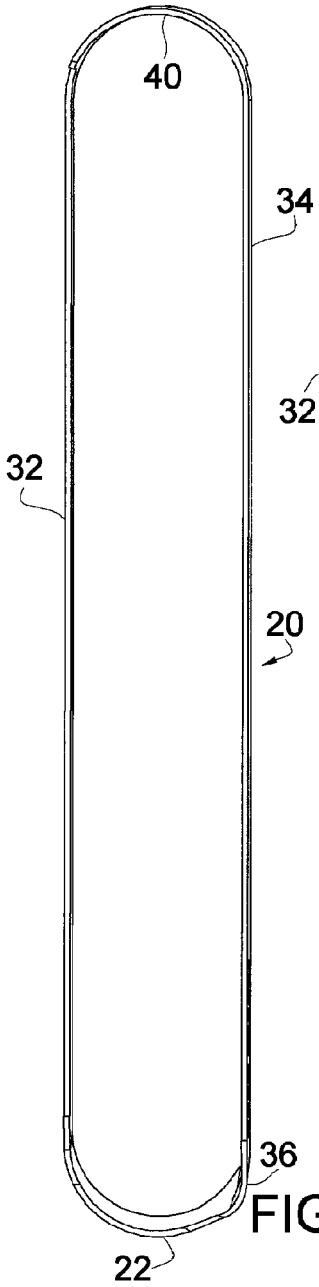
FIG. 3
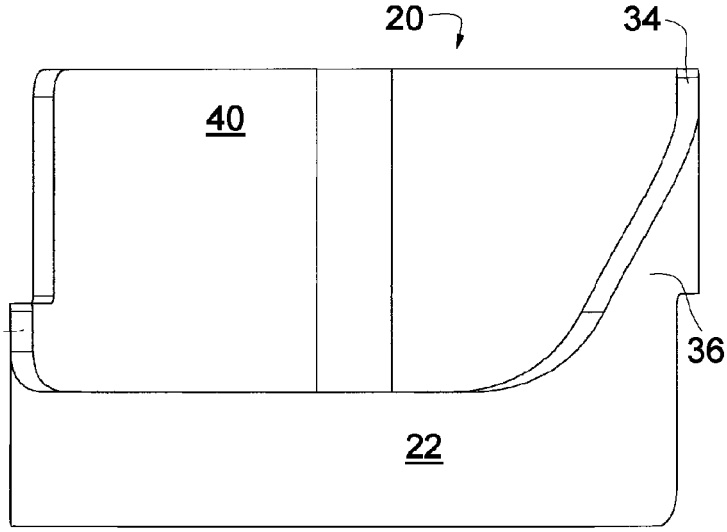
FIG. 4
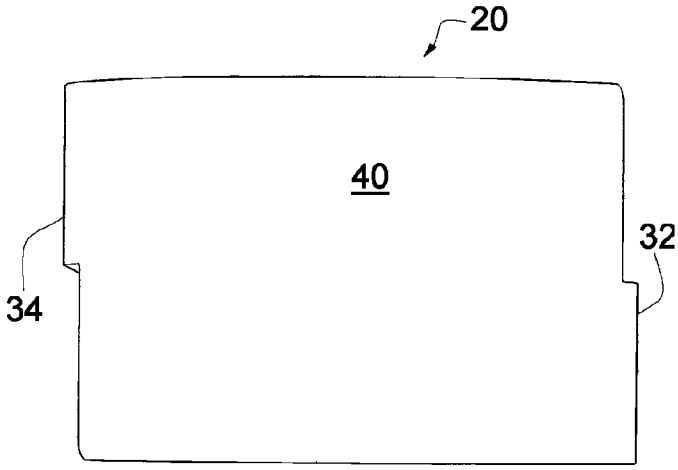
FIG. 6
FIG. 5
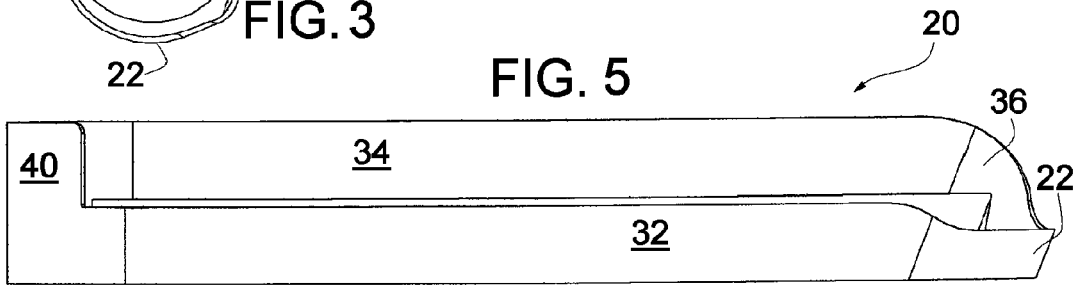

SPACE SAVING MANUAL SHELF MANAGEMENT SYSTEM

RELATED APPLICATIONS

This application claims the benefit of U.S. Provisional patent application Ser. No. 60/975,632 filed Sep. 27, 2007 entitled "Manual Shelf Management System." This application claims the benefit of U.S. Provisional patent application Ser. No. 61/032,673 filed Feb. 29, 2008 entitled "Manual Shelf Management System."

BACKGROUND OF THE INVENTION

1. Field of the Invention

The present invention relates to manual shelf management systems, and more specifically to a space saving, manual, open bottom, containing and supporting, shelf management system.

2. Background Information

In stores, for example grocery stores, that display products on shelves it is necessary to continually move the products from the rear to the front of the shelf so that customers can more readily see and select those items that they desire. The movement of products towards the front of the shelf is called "facing" or "fronting." It is also essential that the products be arranged laterally (side-to-side) as closely as possible to conserve limited and valuable lateral shelf space, and thereby maximize the products that can be displayed and sold.

Furthermore, if the products are hidden at the rear of the shelf or if an insufficient depth of the shelf is utilized and the product is thereby more readily exhausted, or if the products are in disarray, potential sales are lost. Stocking new products on store shelves requires significant time and effort. Products must be painstakingly positioned on the shelves in straight rows, and sometimes product containers are stacked one on top of the other adding to the difficulty for the worker. Stocking becomes a taxing exercise in finesse and physical exertion, especially when stocking low or high shelves. Further, products are frequently "rotated" with older items brought to the front of the shelf and newer items placed in the rear. Also, products are occasionally moved to a different location of the store altogether, called "resetting" of the products. Ordinarily all of these so-called "shelf conditioning" tasks described above require the handling of each individual item (e.g. each soup can). This individual handling of items is time-consuming, imprecise and creates fatigue for store personnel.

The prior art has addressed some of these issues and developed relatively complex machines to advance rows of products on a shelf. These devices are generally complex with multiple parts, are expensive, and involve a complicated installation. Further, some of these prior art devices do not maximize the amount of lateral shelf space available for product display.

U.S. Pat. Nos. 1,703,987; 2,652,154; 3,028,014; 3,083,067; 3,110,402; 3,357,597; 4,300,693; 4,724,968; 4,729,481; 4,730,741; 4,762,236; 4,830,201; 4,836,390; 4,901,869; 4,907,707; 5,012,936; 5,069,349; 5,111,942; 5,123,546; 5,240,126; 5,450,969; 5,542,552 5,992,652; 6,105,791; 6,129,218; 6,357,606; 6,382,431; 6,484,891; 6,772,888; 6,886,700; 6,889,854; 7,063,217; and 7,168,579 disclose complex mechanisms for advancing product rows which, in general, provide a spring-biased backstop which constantly and automatically forces the products from the rear toward the front of the shelf. While these so-called "spring-loaded" devices are generally effective for managing light-weight merchandise (e.g. packages of panty hose) they are generally not effective when used for heavier items (e.g. jars of pasta sauce). They are also complex with combined plastic and metal construction and are relatively costly. Additionally, the constantly biased backstop can increase the difficulty of restocking the shelves, as in all of these arrangements, the spring-biased backstop must be pushed back with one hand while the new products are positioned on the shelf. Further, the springs can lose their tension over time rendering the system less effective.

U.S. Pat. Nos. 4,768,659, 4,785,945, 5,160,051 and 5,197,610 disclose shelf management systems that utilize an inclined shelf where products are urged to the front of the shelf by force of gravity. These so-called "gravity fed" systems will not operate with existing flat shelves; rather, the existing shelving is removed and new inclined shelves are installed. A time-consuming and costly installation process is required that involves wholesale removal of existing store shelving and installation of new shelving.

U.S. Pat. No. 6,991,116 discloses a "gravity fed" shelf management system that installs on existing flat supermarket shelving. While effective in merchandising cans, this system is less effective for jars and will not work for boxes. It also requires special vertical shelf spacing. This system is complex, is relatively expensive, requires an involved installation and is difficult to move in the case of a resetting of the products.

U.S. Pat. No. 4,042,096 discloses a shelf management system having a "pusher" disposed behind the row of products with side members tying the pusher to a pull handle at the front of the shelf and to confine the row of objects laterally in alignment. A rail is disposed at the front of the shelf to prevent objects from falling off the shelf as the pusher is drawn forward by the handle. Resilient means are disposed behind the pusher to return it and the handle to normal position after being drawn forward by a pull on the handle. The system does not present a compact shelf management solution and incorporates a significant number of components including a return spring that is subject to fatigue and failure. The accumulated thicknesses of the side members, which stack laterally against one another, consume too much lateral shelf space and selling space is lost.

U.S. Pat. No. 2,079,754 discloses a complex arrangement with multiple parts which combines the dispensing of the products with the movement of the products toward the front of the shelf. The side members are arranged in a laterally stacking fashion such that the accumulated thicknesses of the side members combine to consume too much lateral shelf space. Selling space on the shelf is thereby lost. Multiple parts of this complex system include a detached "floating" backstop as well as a separate pulling and article receiving component that is manually operated for product movement and dispensing.

U.S. Pat. No. 2,098,844 discloses a shelf management system that forms a product supporting tray within which the product can be advanced. This is a complex, multi-piece system that requires installation of components both on the top and on the underside of the shelf such that most standard store shelves would have to be replaced with custom-designed shelves to accommodate this system. Further, because the side members of the frames of this system laterally stack against one another, the accumulation of the combined thicknesses of the side members consumes too much lateral shelf area. Lateral selling space on the shelf is lost.

U.S. Pat. No. 6,719,151 and US Published Patent Application Number 2004/0178158 disclose a wire frame shelf management system that provides a manual open bottom shelf management system. The system is designed primarily to fit under the open, concave rounded edges at the base of certain products (e.g. jars of pickles) and fails to provide significant lateral support for the products. This lack of lateral support can result in products moving to the left or right or even tipping over during advancement creating significant problems during product movement. Further, to use this system for products that do not have rounded edges at the base, such as cans and small boxes, a specially formed tray must be installed to elevate the displayed products to create a space underneath the products within which the system can function. In an alternative embodiment wedge-shaped dividers are provided which offer limited lateral support; however, in this embodiment, the wedge-shaped dividers laterally stack side-to-side and the accumulated thicknesses of these dividers consume too much lateral selling space. In its preferred embodiment this system fails to provide lateral product support. In a further embodiment the system requires an additional tray apparatus to function which requires an added installation step and added cost. In a still further embodiment the system employs wedge-shaped dividers that stack side-to-side thereby consuming valuable lateral selling space.

U.S. Pat. No. 7,124,897 discloses an assembly deployed on a complex multi-piece platform and features a base divided into rows with dividers. For each row there is a manually-operated pusher mechanism in the form of a rectangular wire device with a front handle and a rear portion that is bent upwards to form a back-stop. The sides of the wire device ride in grooves positioned along either side of the base on which the products rest. This system is complex with multiple parts and would be relatively costly to produce. Neither the divider spacing nor the width of the pusher mechanism is adjustable; therefore this system can not be adapted to accommodate products that differ in width from those for which the system was originally designed. In an alternative embodiment merchandise rides on a base with integral ball bearings or rollers, in either case a complicated and costly feature.

U.S. Pat. Nos. D472,411; 1,702,987; 1,708,407; 1,910,046; 2,980,259; 5,411,146; 5,413,229; 5,469,976; 5,638,963; 6,082,556; 6,155,438; 6,227,386; 6,375,015; 6,527,127; 6,823,997; and 6,923,330 disclose a variety of shelf management systems that are representative of the art. All of these systems use complex designs with multiple pieces. All are relatively costly, and all require involved installation.

The above identified patents are representative of the art and these references are incorporated herein by reference in their entirety. It is the object of the present invention to address the deficiencies of the prior art shelf management systems and provide a highly effective, very low-cost, easy to install and easy to use shelf management system.

SUMMARY OF THE INVENTION

The present invention is drawn to a manual open bottom shelf allocation and management system for allocating shelf space among rows of products and for moving the rows of products toward the front of the shelf. The system includes a plurality of adjacent shelf allocating and managing units. Each unit includes a pair of side dividers extending away from a front to a backstop defining an open bottom, wherein at least one row of products may be positioned on the shelf between the side dividers, wherein the side dividers individually or in combination provide substantive lateral support for the products. Each unit is manually movable between the front and the back of the shelf and is adapted to advance at least one row of products toward the front of the shelf. In one aspect of the present invention the side dividers of two adjacent units are in vertical alignment with one another such that the space between the side dividers of adjacent units which accommodate the rows of products associated with that unit is separated by a distance equal to the thickness of only one side divider.

One aspect of the present invention provides a manual open bottom shelf allocation and management system for allocating shelf space among rows of products and for moving the rows of products toward the front of the shelf. The system comprises a plurality of adjacent shelf allocating and managing units, each unit associated with at least one row of products. Each unit of the system includes a front adapted to be in front of the rows of products near a front edge of the shelf; a backstop spaced from the front adapted to be positioned behind the at least one row of products associated with the unit; and a pair of side dividers extending away from the front to the backstop defining an open bottom adjacent the shelf, wherein the at least one row of products associated with the unit may be positioned on the shelf between the side dividers, and wherein each unit is manually movable in a direction extending between the front and the back of the shelf substantially perpendicular to the lateral length of the shelf whereby each unit is adapted to advance the at least one row of products associated with the unit toward the front of the shelf, and wherein the side dividers provide for substantive lateral support for the products adjacent the dividers, at least when a side divider is coupled with a side divider of an adjacent unit.

One aspect of the present invention provides a manual open bottom shelf allocation and management system for allocating shelf space among rows of products and for moving the rows of products toward the front of the shelf. The system comprises a plurality of adjacent shelf allocating and managing units, each unit associated with at least one row of products. Each unit of the system includes a front adapted to be in front of the rows of products near a front edge of the shelf; a backstop spaced from the front adapted to be positioned behind the at least one row of products associated with the unit; and a pair of side dividers extending away from the front to the backstop defining an open bottom adjacent the shelf, wherein the at least one row of products associated with the unit may be positioned on the shelf between the side dividers, and wherein each unit is manually movable in a direction extending between the front and the back of the shelf substantially perpendicular to the lateral length of the shelf whereby each unit is adapted to advance the at least one row of products associated with the unit toward the front of the shelf; and a width adjusting mechanism allowing the spacing between the pair of side dividers to be adjusted to accommodate the width of the products, wherein the width adjustment mechanism will secure the side dividers in a plurality of selected relative positions.

One aspect of the present invention provides a manual open bottom shelf allocation and management system for allocating shelf space among rows of products and for moving the rows of products toward the front of the shelf. The system comprises a plurality of adjacent shelf allocating and managing units, wherein each unit is associated with a plurality of rows of products and each unit includes:

a front adapted to be in front of the rows of products associated with the unit near a front edge of the shelf; a backstop spaced from the front adapted to be positioned behind the rows of products associated with the unit; a pair of side dividers extending away from the front to the backstop defining an open bottom adjacent the shelf, wherein a plurality of rows of products associated with the unit may be positioned on the shelf between the side dividers, and wherein each unit is manually movable in a direction extending between the front and the back of the shelf whereby the unit is adapted to advance the plurality of rows of products between the side dividers toward the front of the shelf, and each unit includes at least one middle divider laterally spaced from the side dividers and extending away from the front to the backstop between the rows of products.

One aspect of the present invention provides a shelf allocation and management system for allocating shelf space among rows of products and for moving the rows of products toward the front of the shelf. The system comprises a plurality of adjacent shelf allocating and managing units with each unit associated with at least one row of products. Each unit includes a backstop adapted to be positioned behind at least the row of products associated with the unit, wherein each backstop is movable to advance at least one row of products associated with the unit toward the front of the shelf; and a pair of side dividers extending along the sides of the at least one row of products associated with the unit, wherein at least one row of products associated with the unit may be positioned on the shelf between the side dividers, and wherein the side dividers provide for substantive lateral support for the products adjacent the dividers, wherein the side dividers of two adjacent units are in vertical alignment with one another such that the space between the side dividers of adjacent units which accommodate the rows of products associated with that unit are separated by a distance equal to the thickness of only one side divider.

These and other advantages of the present invention will be clarified in the description of the preferred embodiments.

BRIEF DESCRIPTION OF THE PREFERRED EMBODIMENTS

FIG. 3 is a top view of the shelf allocating and managing unit of FIG. 2;

FIG. 4 is a front view of the shelf allocating and managing unit of FIG. 2;

FIG. 5 is a side view of the shelf allocating and managing unit of FIG. 2;

FIG. 6 is a back view of the shelf allocating and managing unit of FIG. 2;

DESCRIPTION OF THE PREFERRED EMBODIMENTS

Figure 1:
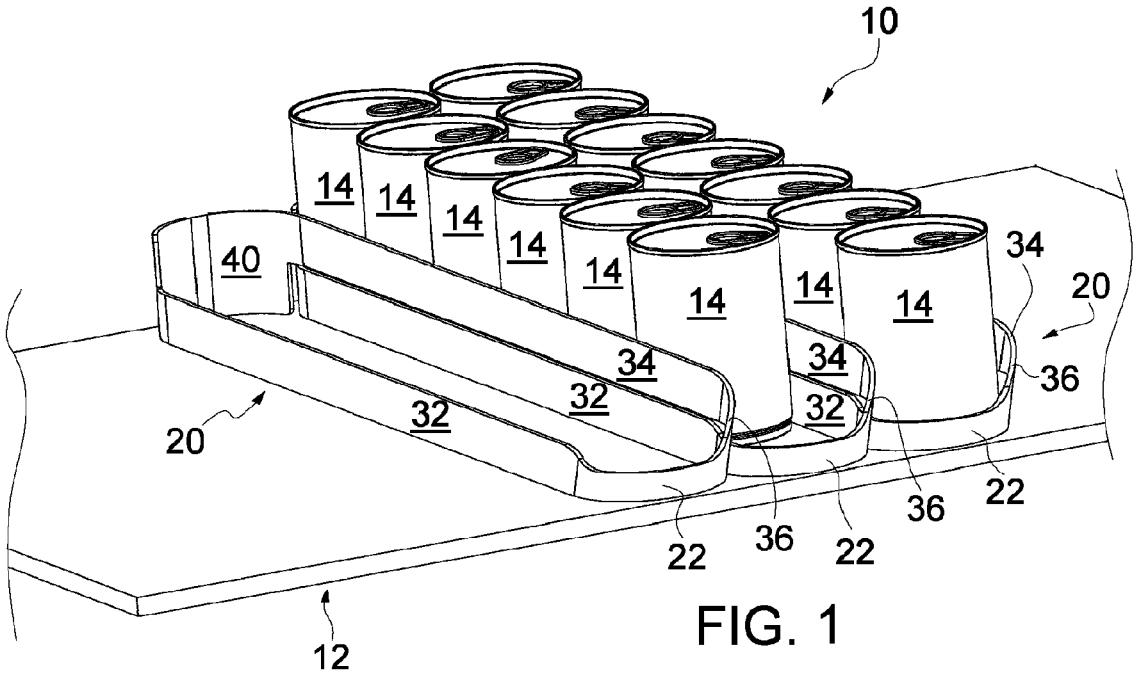
FIG. 1 is a perspective view of a manual open bottom shelf allocation and management system according to one aspect of the present invention.
Figure 2:
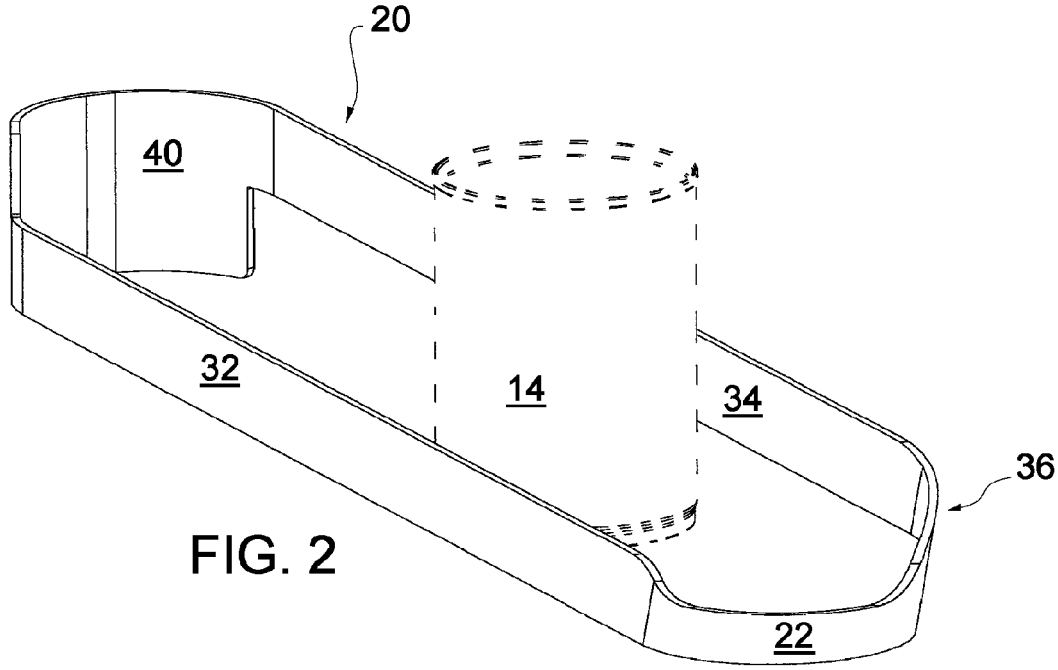
FIG. 2 is a perspective view of a shelf allocating and managing unit of the manual open bottom shelf allocation and management system of FIG. 1.
Figure 7:
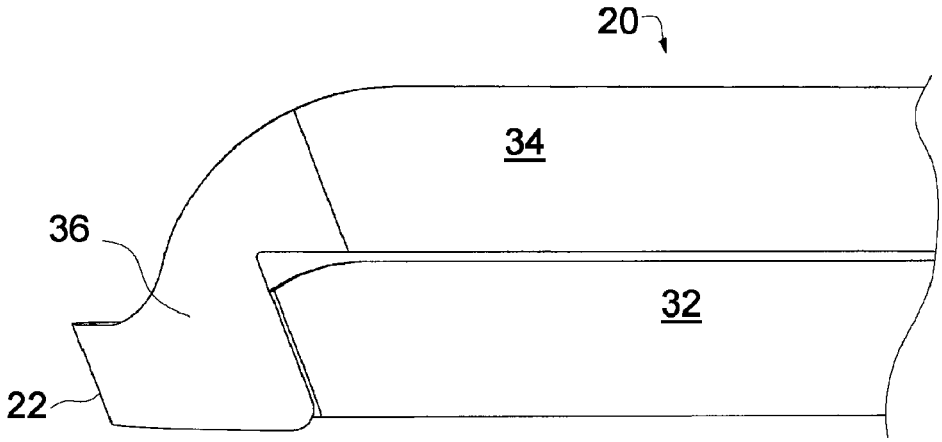
FIG. 7 is a section view of the front end of the shelf allocating and managing unit of FIG. 2.

It is noted that, as used in this specification and the appended claims, the singular forms "a," "an," and "the" include plural referents unless expressly and unequivocally limited to one referent.

For the purposes of this specification, unless otherwise indicated, all numbers expressing quantities of ingredients, reaction conditions, and other parameters used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

All numerical ranges herein include all numerical values and ranges of all numerical values within the recited numerical ranges. Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

The various embodiments and examples of the present invention as presented herein are understood to be illustrative of the present invention and not restrictive thereof and are non-limiting with respect to the scope of the invention.

The present invention provides a manual open bottom shelf allocation and management system 10 for allocating shelf space along a conventional shelf 12 among rows of products 14 and for moving the rows of products 14 from the rear or back of the shelf 12 toward the front edge (or front) of the shelf 12. The direction of movement is standard in shelf management systems and is generally perpendicular to the lateral length of the shelf 12. The term manual within this application and in connection with the system 10 references that only manual movement is used in the system, as opposed to spring assisted systems or gravity assisted systems. As further described below, aspects of the present invention can be used in non-manual systems.

The system 10 includes a plurality of adjacent shelf allocating and managing units 20 best shown in FIGS. 2-7. Each unit 20 may be, in certain embodiments, a one piece unit and can be formed easily as a one piece molded construction, such as by injection molding. It may also be desirable for the unit 20 to be formed as an assembly for the purpose of making the unit 20 adjustable and possibly also to facilitate manufacturing and shipping.

Each unit 20 includes a front 22 which is a relatively low profile structure such that any possible interference between the front 22 and the products 14 will be minimized when customers are removing products 14 from the associated row on shelf 12 should the customer not lift the product 14 high enough to clear the front 22. The front 22 may be modified to receive an identification label for the products 14 that are associated with the unit 20.

Each unit 20 includes a lower side divider 32 and an upper side divider 34 that together form a pair of side dividers extending away from the front 22 and generally extending the effective depth of the shelf 12. The length of the dividers 32 and 34 (and of the associated unit 20) will be, preferably, governed by the depth of the shelf 12 to maximize usable shelf space. Lengths of 10"-40" for units 20 are possible, with 14"-26" lengths for unit 20 covering the vast majority of retail shelving 12.

Manufacturing of the unit 20 as a single injection molded piece would allow for the lowest manufacturing cost. As an alternative, the unit 20 can be assembled by joining together a separate front 22, a separate back-stop 40, a separate divider 32 and a separate divider 34 that are manufactured in varying lengths so that shelves 12 of different depths could be accommodated with the corresponding correct length of dividers 32 and 34, and further that products 14 of different widths could be accommodated with the correct lengths of front 22 and back-stop 40 that correspond to the width of the product 14. Further, with separate components forming the units 20, products 14 that may be tall or stacked one atop the other could be adequately supported with backstops 40 and dividers 32 and 34 of different heights than found in other units 20. These component pieces could be manufactured either through injection molding or extrusion and could be scored so that each section could be shortened (possibly by snapping off) in increments of possibly 0.5" for the dividers 32 and 34 and increments of possibly 0.10" for the front 22 and back-stop 40.

In a further alternative, the front 22, and dividers 32 and 34 could be manufactured as a single piece and backstops 40, in various heights, could be attached to complete a unit 20.

The front 22 in the unit 20 is coupled to upper divider 34 through post 36. Beginning at the front end of divider 34, post 36 simultaneously curves laterally inward and vertically downward to connect with front 22. Post 36 allows upper divider 34 to be positioned in such a way that the bottom edge of upper divider 34 is maintained at a vertical point above the top edge of lower divider 32 of the same (and adjacent) unit 20 at all points along its length. In this way, when two units 20 are placed together side-by-side, the divider 34 of one unit rides over divider 32 of the adjoining or adjacent unit without touching divider 32 at any point, and when two units 20 are placed together side-by-side a single-thickness divider along the lateral dimension of the shelf 12 is presented along the entire length of dividers 32 and 34. On the vertical dimension, the divider 34 of one unit "stacks" on top of (but does not touch or interfere with) the divider 32 of the adjoining or adjacent unit 20 thereby presenting a higher combined divider (32+34) that provides substantial lateral support for the products 14 associated with the respective units 20. The lateral support is not diminished if there is a gap between the dividers 32 and 34.

The combined dividers 32 and 34 (or individual dividers 32 or 34 in the case of the end unit 20 of a system 10) provide lateral support of the products 14. Lateral support of the products 14 is useful in that it confines the product row(s) associated with a given unit 20 and maintains the row in a more or less straight line both when new products 14 are placed on the shelf 12, as when occurs when stocking, and when the product row is pushed forward by the backstop 40, as occurs when the front 22 is pulled forward, as occurs when facing or fronting a product row associated with a unit 20. Lateral support also discourages the products 14 from tipping to the side. Further, lateral support prevents products in one row associated with a unit 20 from co-mingling with (different) products in adjoining rows. Effective lateral support of the product 14 can be achieved with a divider that is substantially lower than the top of the product 14, or, if the products 14 are stacked one-on-another, the top of the product 14 stack.

Due to the symmetrical nature of many products 14 and the low-friction nature of the surface of the shelf 12 the dividers can be of relatively low height and still provide substantial lateral product support. In order to provide some quantitative guidelines, substantive lateral support within the meaning of this application will mean a sidewall height of at least 15% of the height of the product or product stack height. If the product or product or product stack is relatively stable then substantive lateral support would mean approximately 15-50% of the height; conversely if the product or product stack has low stability, then substantive lateral support would mean approximately 20-90% of the height. The "sidewall height" within the meaning of this application is the combined height of the dividers 32 and 34, including any gap there between, measured when two units 20 are placed together side-by-side.

The dividers 32 and 34 are defined by three dimensions: the thickness of the divider, the length of the divider (corresponding roughly to the shelf depth) and the planar height of the divider. To illustrate, although the top edge of divider 34 may be 4" above the shelf, the planar height of the divider 34 may be only 1¾". The divider 34 is in all embodiments, other than the embodiments of FIGS. 18 and 19 which reference this as element 34', suspended above the shelf 12 so its planar height will always be smaller than the distance from the shelf surface to the top edge of divider 34.

In one aspect of the invention it is preferred that the dividers 32 and 34 be about the same planar height, and also about the same thickness, about the same length, and about the same weight essentially providing a balance between the dividers 32 and 34 and therefore balancing the unit 20 so that it may rest squarely on a flat shelf even when no products 14 are displayed within the unit 20. This balance allows for substantive lateral support of about ½ the total sidewall height to be provided on each side of the products 14 even for the last unit 20, on either the left side or right side, within a system 10 comprised of multiple units 20.

The dividers 32 and 34 may, in an alternative embodiment, not be balanced with the planar height of divider 32 being taller than the planar height of divider 34 or the planar height of divider 34 being taller than the planar height of divider 32 while, in all cases, the lower edge of divider 34 is at all points along its length above the upper edge of divider 32 so that neither divider 32 or 34 interferes with the movement of the adjacent divider 34 or 32 in use. It is a requirement of the unit 20 construction that the higher that the lower end of divider 34 is relative to the shelf 12 the higher and more extensive is the design of the post 36. Consequently for products 14 that benefit from a relatively high sidewall structure (combined divider height), it may be more preferable to minimize the height of the lower divider 32 and maximize the height of the higher divider 34, which, in turn, minimizes the construction of the post 36. Consequently there is a tradeoff of balanced and unbalanced divider heights for the units 20. In the illustrated embodiments of the present invention having vertically aligned dividers 32 and 34, the side dividers of each unit provide substantial lateral support to the products, at least when a side divider is coupled with a side divider of an adjacent unit. In many implementations the side dividers 32 and 34 are of substantive height to provide substantive lateral support individually, however, even if one divider, e.g., divider 32, is of minimal height wherein it does not, individually, provide substantive lateral support to the products, this support will be provided with the combined, aligned dividers.

Having both dividers 32 and 34 allows the unit 20 to form a loop around the products 14 for advancing them. Without one divider 32 or 34 a cantilever structure would result as would significant material considerations (i.e. supporting ribs to prevent bending, forming the unit out of expensive metal, thicker construction for more rigid unit, etc.) Consequently the pair of dividers 32 and 34 is preferred and these combine to form the sidewall structure. In a further modification there may be an increased gap between the lower edge of divider 34 and the upper edge of divider 32. In a still further modification each divider 32 and/or divider 34 and/or backstop 40 and/or front 22 may include openings therein for viewing of the products 14 and/or for stylized purposes and/or to reduce the amount of plastic required for manufacture of the unit 20; and/or to facilitate air flow around the products 14 such as in the case where products 14 require refrigeration.

The lower divider 32 being positioned on the left or right side of the unit 20 and the upper divider 34 being positioned on either side of the unit 20 is unimportant provided that within an installation 10 of units 20, the lower dividers 32 are all on the same side and the upper dividers 34 are all on the opposite side in any series of units 20. Within the illustrated embodiments of this application the lower divider 32 is on the left and the upper divider 34 is on the right solely for the purpose of consistency in illustration.

Extra weight may be added to the rear side of the back-stop 40 of a unit 20 on the same side as the lower divider 32 as a counterweight mechanism. This extra weight may be added in such quantity to reduce or eliminate the tendency of the unit 20 to tip to the side in the direction of the upper divider 34 especially when the unit 20 is pulled forward far enough that the front 22 of the unit 20 hangs beyond the front edge of the shelf. A magnet may also be used to form the counterweight and provide some additional holding or stabilizing force to keep the proper orientation for the unit 20 relative to a metal shelf 12; however such an option may not be cost effective in the overall system.

Especially in the case where a unit 20 may be used to merchandise products that are stacked two-high, three-high or four-high, the top of the upper divider 34 may be approximately the same height as the top of the product stack (for example, in the case of baby food jars stacked 3-high, the top may be about 7" high) so that this stacked merchandise can be more securely contained within the unit 20. Individual pieces of merchandise or product 14 are less apt to fall to one side or the other. In order to reduce the degree to which these higher dividers might obstruct the side view (of a store customer) of the product or product stack, the front of the upper divider 34 may be swept back at an angle so that towards the front section of the upper divider 34 the top of the upper divider 34 may be, for example, 2" high and would attain increasingly greater height as it extended rearward and would reach its full height (7" in this example) at a point, for purpose of illustration, 8" rearward of the front 22 of a unit 20.

The dividers 32 and 34 allow a convenient place for branding of the unit 20. The branding of the unit 20 may be with the store logo, or may be associated with the product 14. It is expected that the units 20 may be supplied by the manufacturers of the specific products 14 to allow retailers of the products 14 to better display and manage that particular product 14.

Where the manufacturers of the products 14 are supplying to a store the units 20 of a system 10 there is no difficulty in matching the width of the unit 20 to the width of the product 14 associated with each unit 20. The manufacturers can use the offer of a low-cost, or free, system 10 to encourage a retailer to stock a particular line of products 14 from the manufacturer and/or to obtain a desired shelf placement. The decrease in stocking, facing (bringing products to the front of the shelf), rotating and product resetting times will be advantageous to the retailer, while the improved product presentation and increased sales from having properly positioned products 14 will inure to the benefit of both the manufacturer and the retailer. Further, these advantages may lead to an increase in the facings for products, i.e. the amount of lateral shelf space available for products, associated with the units 20 that the retailer provides to this manufacturer, which will further increase the benefits to the retailer and the manufacturer.

Where the system 10 is purchased by the store itself then a variety of sizes of units 20 would be selected so the retailer can accommodate the variety of products sold in the store, or adjustable units 20 would be purchased so the store personnel could adjust the width (and possibly the length) of the units 20 to accommodate various widths of products 14 and various shelf depths. The decrease in stocking, facing (bringing products to the front of the shelf), rotating and product resetting times will be advantageous to the retailer. The decrease in these times should yield an increase in sales as more products are properly presented to the customer. Further, with the retailer purchased systems the retailer can determine which particular products should be utilized with the system to maximize the improvements for the store.

The design of the unit 20 incorporating a divider 34 that is, along its entire length, positioned above divider 32 allows for a minimal lateral distance between the rows of products 14, namely only the thickness of a single divider 32 or 34. When an array of units 20 are placed together to form a system 10, the divider 32 of one unit 20 is positioned directly under the divider 34 of an adjoining unit 20 positioned to the left, and the divider 34 is positioned directly over divider 32 of an adjoining unit 20 positioned to the right such that a combination of dividers 32 and 34 form a single divider 32 or 34 thickness. The dividers 32 and 34 of these embodiments of the present invention do not stack one against the other side-to-side (laterally, as contrasted with the laterally stacking side dividers 32' and 34' embodiments of FIGS. 18 and 19); rather the dividers 32 and 34 ride over and under each other (preferably without significant contact). Critical lateral shelf space is thereby preserved as only a single divider thickness 32 or 34 separates one row of products 14 from the next row of products 14.

The thickness of the dividers 32 and 34 will vary depending upon the material used. However for an injection molded plastic unit 20 the thickness of the divider 32 or 34 will be approximately 1/10" or less. The thickness of the dividers 32 and 34 is substantially equal, and generally only as thick as necessary to provide an adequate side divider and to couple the unit 20 together and to maintain structural integrity of the unit 20. An unequal thickness in the dividers 32 and 34 would needlessly increase the effective width of the system 20. If the dividers of a shelf management system were to occupy even a minimal extra width of, for example, 1/8", selling space would be lost over the lateral length of the shelf as these divider thicknesses accumulated. If a shelf management system results in too much lost product selling space then the advantages of such a system could be overshadowed by the lost product selling space, and the system might be frowned upon by the retailers.

The front 22, dividers 32 and 34 and backstop 40 define an open bottom, whereby at least one, and often only one, row of products 14 is positioned between the side dividers 32 and 34 on the shelf 12. Especially in the case of interlocking cans and interlocking jars, the products 14 may be stacked one on top of the other. Each unit 20 is manually movable between the front and the back of the shelf 12 via the operator grasping the front 22 (or grasping the optional label holder 26) and pulling forward to advance the row of products 14 from the rear towards the front of the shelf 12. When the unit 20 is drawn forward the backstop 40 engages the rearmost item (or stack of items) in the row of products 14 and moves the products 14 towards the front of the shelf 12. As the rearmost product 14 is moved forward it contacts and pushes forward the next product in the row and so on until all of the products in the row are moved forward. The backstop 40 is pulled forward on both sides by the dividers 32 and 34. With the products 14 advanced towards the front of the shelf 12 the unit 20 is slid back to the starting position with the front 22 positioned approximately at the front edge of the shelf 12.

Figure 9:
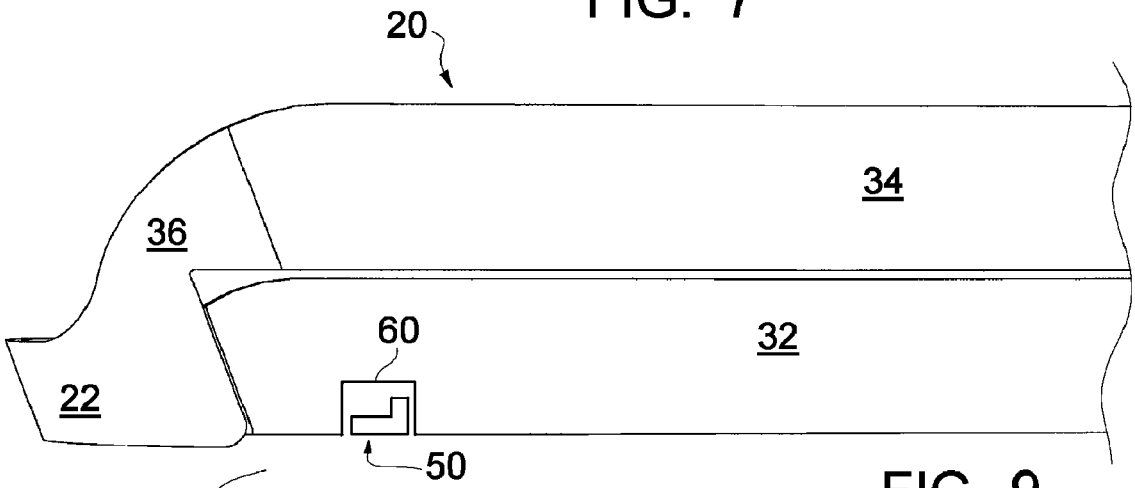
FIG. 9 is a side view of the optional locking front-stop shelf attachment of FIG. 8 engaged with the shelf allocating and managing unit of FIG. 2 modified to receive the locking front-stop attachment.

The system 10 may be used with effectively any shelf 12 with the length of the dividers 32 and 34 being associated with the shelf depth as noted above. The shelf 12 may have an integral front ridge that the unit 20 extends to. Alternatively, the system 10 may include an optional locking front-stop shelf attachment 50. The attachment 50 is comprised of a base 52 and a vertically extending stop 54. The base 52 may have double-sided tape to attach to the shelf 12, or may be formed of or include magnets for attachment to metal shelves 12, or may attach to shelves 12 through other attachment mechanisms. The stop 54 allows a front-stop to be added to a shelf 12 if desired. The lower divider 32 may include a matching female opening 60 for receipt of the attachment 50, if used, as shown in FIG. 9. The attachment 50 will serve two purposes. First it acts as a stop to prevent the advance of products 14 beyond the front edge of the shelf when the unit 20 is drawn forward. Secondly it acts as a locking or restraining member preventing unwanted or unintentional pulling forward of the units 20. The operator needs to grasp the unit 20 and lift the unit 20 so that the attachment 50 is out of engagement with the opening 60 at which point the unit 20 can be pulled forward.

The attachment 50 may be placed farther forward on the shelf 12 relative to the unit 20 essentially in front of the unit 20. In this construction the opening 60, if provided, may be in the front 22 formed as a cutout or "scoop out" portion of the lower edge of the front 22. The attachment 50 may take a number of forms other than the L shape shown, for example a low profile rectangular cross section protruding about 1/8" above the surface of the shelf 12 can be effective.

Figure 10:
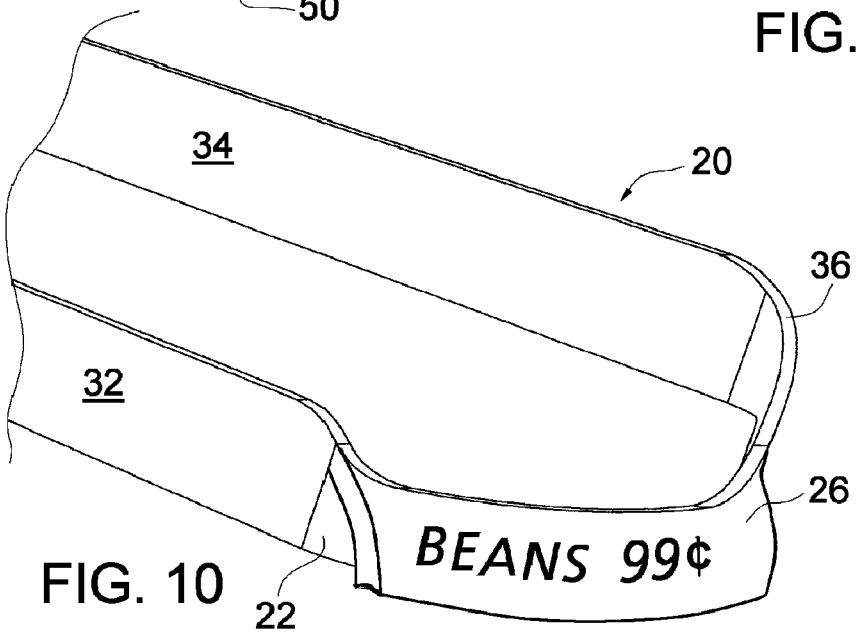
FIG. 10 is a perspective view of the optional label holder that can be attached to the front of the shelf allocating and managing unit of FIG. 2.
Figure 8:
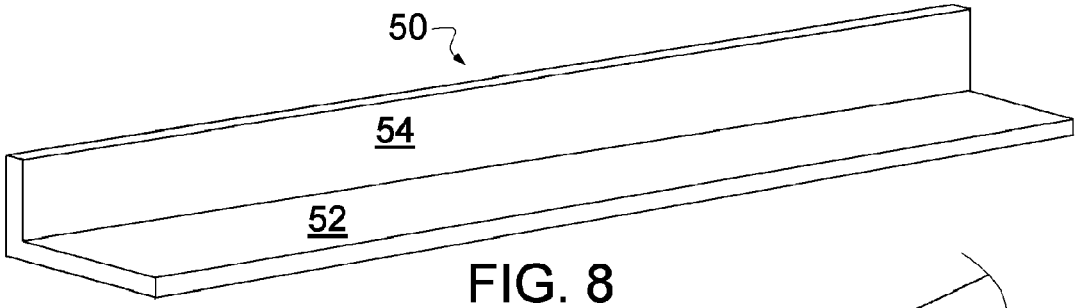
FIG. 8 is a perspective view of an optional locking front-stop shelf attachment for use with the shelf allocation and management system of FIG. 1.

FIG. 10 illustrates an optional feature for unit 20. For the purpose of displaying identification and price information about the products 14, an optional label holder 26 can be removably attached to the front 22 of unit 20. By using the label holder 26, identification and pricing information would be positioned directly in front of the products 14 associated with that unit 20 at all times. The traditional method is to affix the identification and price labels to the shelf edge below the products 14. Because the position of the labels on the shelf edge may not correspond directly to the position of the products 14 confusion can result where shoppers can not easily ascertain the price and identification of the product 14.

Figure 11:
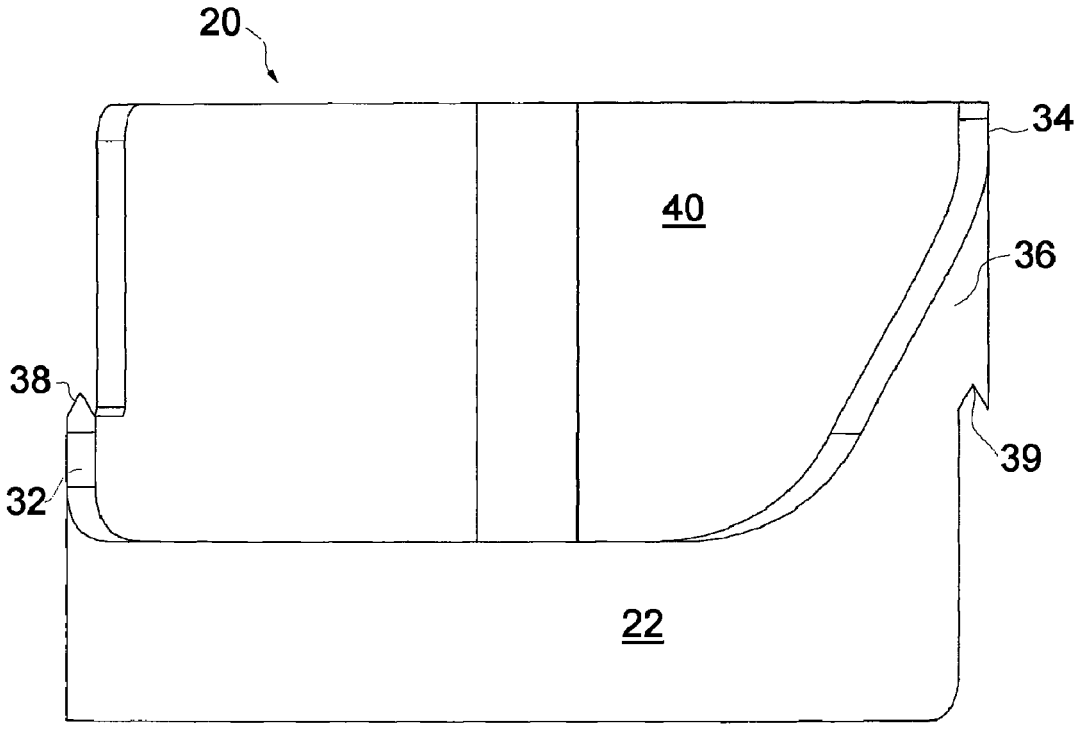
FIG. 11 is a view of the optional interlocking channel and ridge modification of the shelf allocating and managing unit of FIG. 2.

FIG. 11 illustrates an optional interlocking channel and ridge modification. In this modification a male ridge 38 is added along the entire length of the top edge of side divider 32 and a female channel 39 is added to the entire length of the bottom edge of side divider 34. Ridge 38 is shaped to dovetail with channel 39 such that side divider 32 of one unit 20 can slide underneath side divider 34 of an adjacent unit 20 in a forward and backward direction yet movement of the respective dividers laterally apart from one another is prevented.

A further modification along the engagement arrangement shown in FIG. 11 is the use of a sliding interconnecting arrangement between the respective aligned dividers 32 and 34. Such as, for example, a T-slot in one divider and a corresponding T-projection on the other divider to lock the dividers of two adjacent units 20 together in both lateral and vertical movement. A rod with corresponding snap fit couplings is another coupling technique that could be used for locking the dividers 32 and 34 of two adjacent units 20 together against lateral and vertical displacement. In these interlocking arrangements it is, of course, critical that the dividers 32 and 34 maintain complete freedom of movement in the "forward and backward" direction for unit 20 operation. Further, with the sliding engagement of the dividers 32 and 34 it is helpful to make at least the engaged components out of minimum-friction materials that would not detrimentally effect the operation of the respective units 20.

Figure 12:
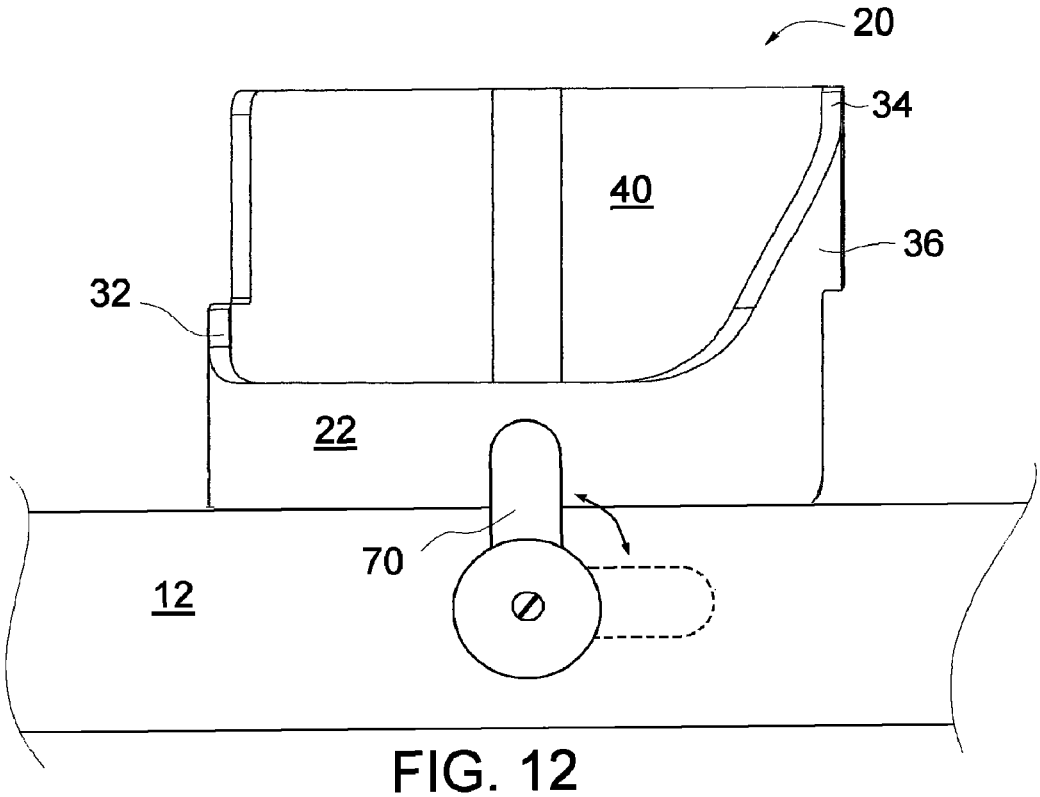
FIG. 12 is a front view of an optional latch for the shelf allocating and managing unit of FIG. 2.

FIG. 12 illustrates an optional latch 70 for the shelf allocating and managing unit 20 that can be installed on the shelves 12 if desired. The latch 70 engages in front of the front 22 (or in front of the optional label holder 26) preventing movement of the unit 20 unless the latch 70 is pivoted out of the way. FIG. 12 is merely shown to illustrate one of the possible additions to the system 10 than can be added if desired. In general the units 20 need not have securing latches 70 or attachment 50 but these can be provided at the option of the retailer. Certain products 14 and certain shelf placements (i.e. those shelves 12 within easy reach of children) may make the latch 70, attachment 50 or similar securing device(s) more desirable for some units 20. The latch 70 and the attachment 50 described above can both be considered as unit arresting members in that each element prevents, to a certain extent, unintended movement of the unit 20 and stops or arrests the movement of the unit 20 to some extent.

Figure 13:
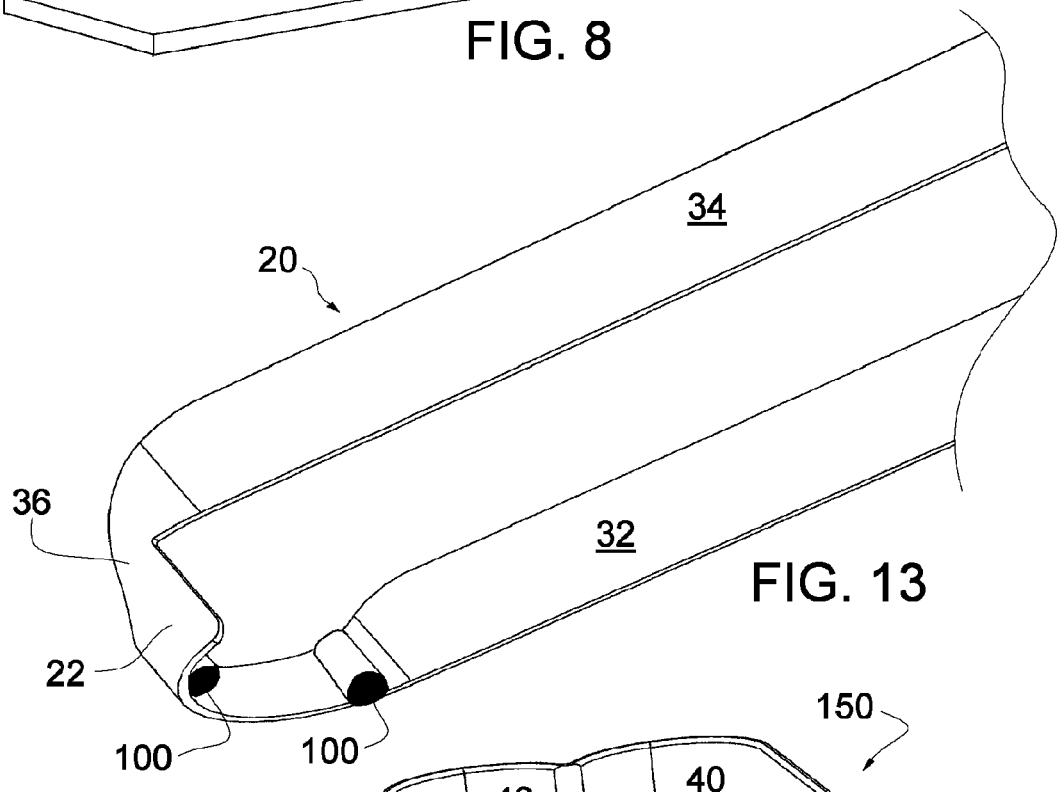
FIG. 13 is a perspective view of the underside of the front end of the shelf allocating and managing unit of FIG. 2 showing optional downward-pointing magnets.

FIG. 13 illustrates a unit 20 with optional magnets 100 attached to the front 22 of the unit 20. One or multiple magnets 100 could be attached to the underside of the front 22 or to the underside of the front portion of divider 32 for the purpose of securing the unit 20 in place while it is not being operated. To operate a unit 20 outfitted with these magnets 100 the store clerk (or customer) would have to tug the front 22 with an extra amount of force to disengage the magnets 100. The strength of the magnets 100 would be enough to keep the unit 20 in position in the event that it was bumped as in the case of a customer making incidental contact, but the strength would not be so much that disengaging the magnets 100 would be too difficult to allow for easy operation. The magnets 100 could also be placed in the lower portion of the backstop 40 of the unit 20.

Figure 14:
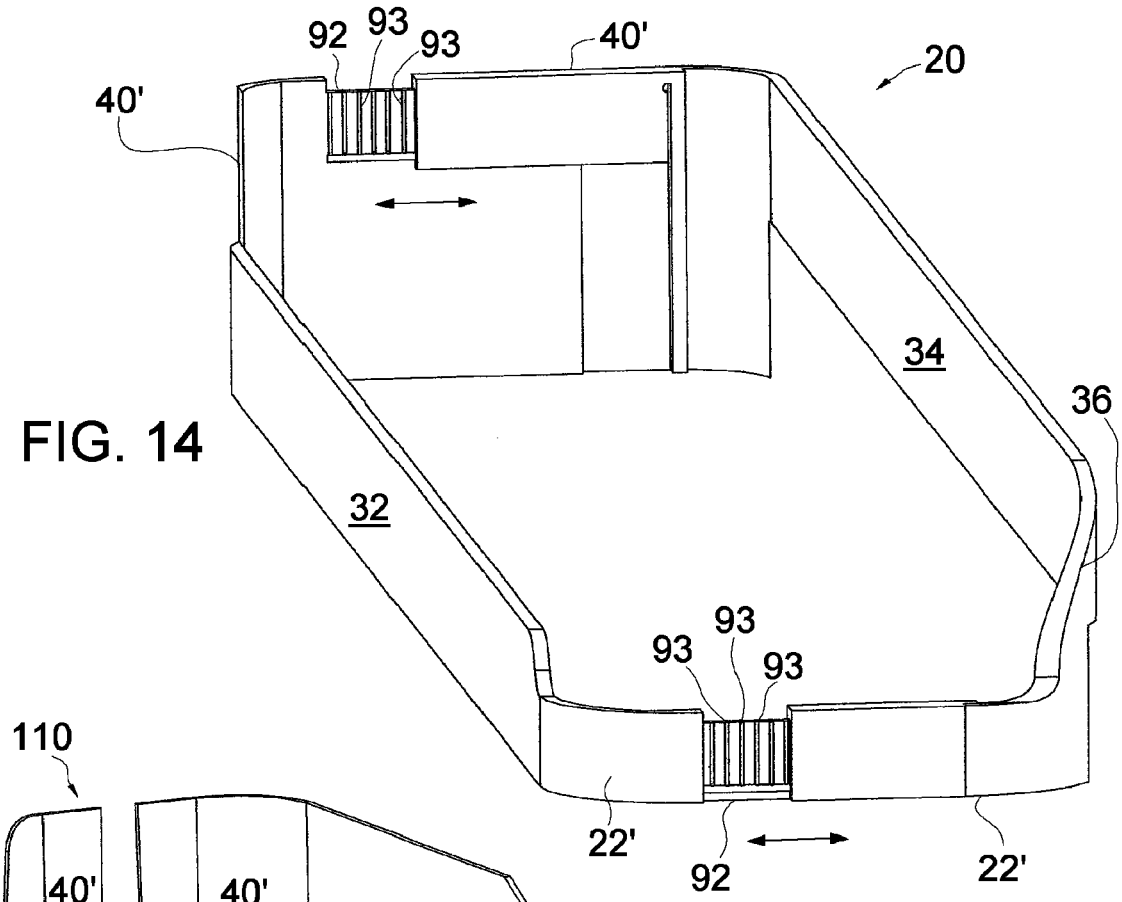
FIG. 14 is a perspective view of an alternative, adjustable shelf allocating and managing unit of the shelf allocation and management unit of FIG. 2.

It will be appreciated by those skilled in the art that changes could be made to the embodiments described above without departing from the broad inventive concept thereof. FIG. 14 illustrates one such modification to the present invention. In this modification the one piece integral unit 20 is replaced with a two piece version.

The two piece unit 20 of FIG. 14 has overlapping backstops 40' and fronts 22'. In this manner the width of the unit 20 can be adjusted to fit the particular product 14. In one possible design, to connect the two pieces of unit 20, a downward-pointing female slot (not shown) on both the back-stop 40' and the front 22' will receive corresponding upward-pointing male inserts 92 on the back-stop 40' and front 22'. The female slots contain a series of vertical groves (not shown) spaced approximately 1/10" apart which correspond to identically-spaced vertical ridges 93 on the male insert such that the unit 20 can be adjusted to accommodate products 14 of varying widths. The adjustable range would vary but might be, for purpose of illustration, 2.4" to 3.4" so that, at its narrowest position the unit 20 would accommodate a product 14 that was 2.4" in width, and at its widest, might fit a product 3.4" in width.

Other designs might be employed to allow the unit 20 to be infinitely adjusted to accommodate products 14 of different widths. Among them would be the 4-piece version of unit 20 (described above) where a unit 20 was assembled by selecting a front 22 and backstop 40 each of which corresponded to the width and height of the product 14, and selecting a divider 32 and divider 34 corresponding to the depth of the shelf 12 and attaching the four pieces together to form a unit 20. However designed, the adjustable unit 20, after it was adjusted and the component pieces fastened together securely to form a unit 20, would operate in the same fashion as the non-adjustable units 20 described above.

Another design would employ springs or other tension devices positioned in lateral orientation on the front 22 and the backstop 40, either integral to the plastic construction or in the form of attached wire springs, that would urge the two dividers 32 and 34 of one unit 20 to move closer to each other and would allow the dividers 32 and 34 to move apart and together across a range, for example, of one inch, to accommodate products 14 of varying widths.

Figure 15A:
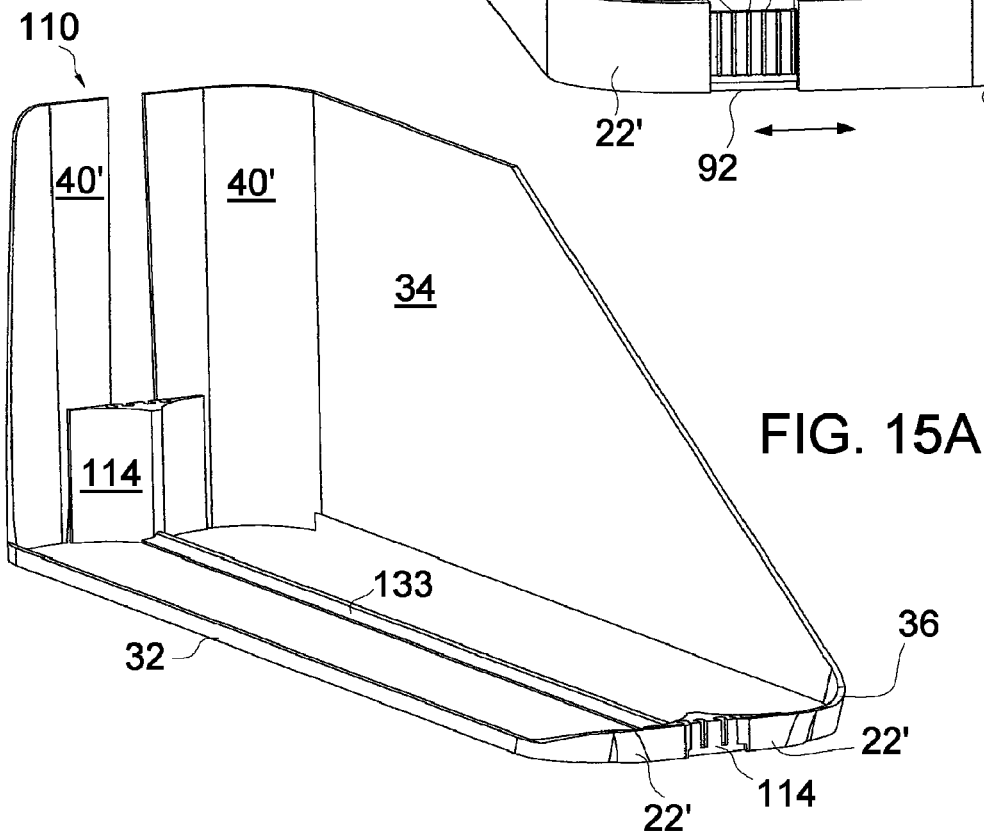
FIGS. 15A and 15B are perspective views of alternative shelf allocating and management units of FIG. 2 that accommodates multiple product rows.

FIG. 15A illustrates a further embodiment whereby two, or more, product rows, situated side-by-side, are contained within one multiple product row unit 110, which in the specific embodiment illustrated is a dual product row unit 110. The effect of the illustrated unit 110 is of two units 20 joined together at the side, along the dividers 32 and 34. The individual product rows within such a unit 110 move in concert with one another when the front 22' of the unit 110 is pulled forward. The two or more product rows within such a unit 110 may be separated by a middle divider 133. Each middle divider 133 may be essentially identical in form to divider 32, or to divider 34, or possibly to the combination of dividers 32 and 34. Forming the divider 133 the same as divider 32 or 34 or the combination thereof is not illustrated as this construction should be well understood from the above discussion. Alternately, as shown in FIG. 15A, for illustrative purposes, in the case of jars, yogurt cups or other product containers where the container sides are not parallel from the extreme top of the container to the extreme bottom of the container, the divider 133 separating the two or more product rows within a unit 110 may be a rod or triangular member that passes, front to back, through the space presented between the products 14 when placed side-by-side. It should be apparent that two, three, four or more product rows might be situated within such a unit 110, with the inclusion of further middle dividers 133 as desired. Such a unit 110 reduces even further the labor required to front or face the merchandise in that two or more rows of product can be moved forward towards the shelf edge with a single pull. This unit 110 is also heavier with a wider base and therefore less apt to be unintentionally tipped over or moved out of place on the shelf especially when it is not filled completely with products 14. The natural disadvantage of such a system 10 using units 110 as compared with units 20 is that it ties two product rows together and thus may not optimize the servicing of one (or more) of the rows of products. In other words, each row within the unit 110 may not have product taken from that row by customers at equal rates. However, if the multiple product 14 rows within a unit 110 cannot be simultaneously faced or fronted because the rows contain unequal amounts of product 14, the unit 110 still offers the advantage of side dividers that maintain the products 14 in proper alignment thereby facilitating stocking and preventing co-mingling of products 14 in adjacent rows.

The dual row version of unit 110 of FIG. 15A is also width adjustable between two width settings for each product row as shown. The backstop 40' for each row is selectively attached to one of two width adjustable positions in adjustment block 114 to provide for such adjustment. The front 22' for each row has a corresponding attachment to one of two positions in a corresponding adjustment block 114. This embodiment is designed for the use with one of two sized products, which can be listed as regular and large size for this discussion. It should be apparent that each unit 110 of FIG. 15A can be orientated to display one of four distinct combinations of product rows. The four combinations include i) two regular size product rows, ii) two large size product rows, and iii and iv) two variations of a combination of one large size product row and one regular size product row. The variations for the combination of large and small product rows within the unit 110 is determined by on which side the large and regular size products are desired.

Figure 15B:
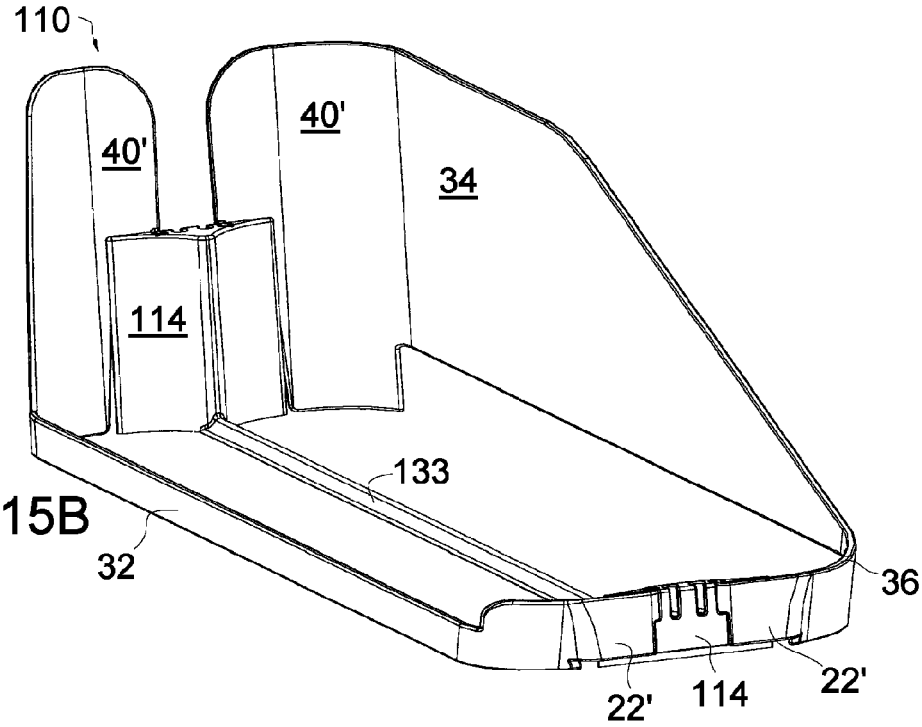

FIG. 15A illustrates a unit 110 with a divider 32 of minimal height. The divider 32 of the unit 110 of FIG. 15A will still provide lateral support for products 14 when aligned with the divider 34 of an adjacent unit 110. FIG. 15B illustrates a unit 110 similar to unit 110 of FIG. 15A, with the difference being that divider 32 of the unit 110 of FIG. 15B is increased to a height sufficient to provide lateral support to a product 14, individually (i.e. the end unit 110 of a series of units 110 will still have lateral support from the divider 32).

Figure 16:
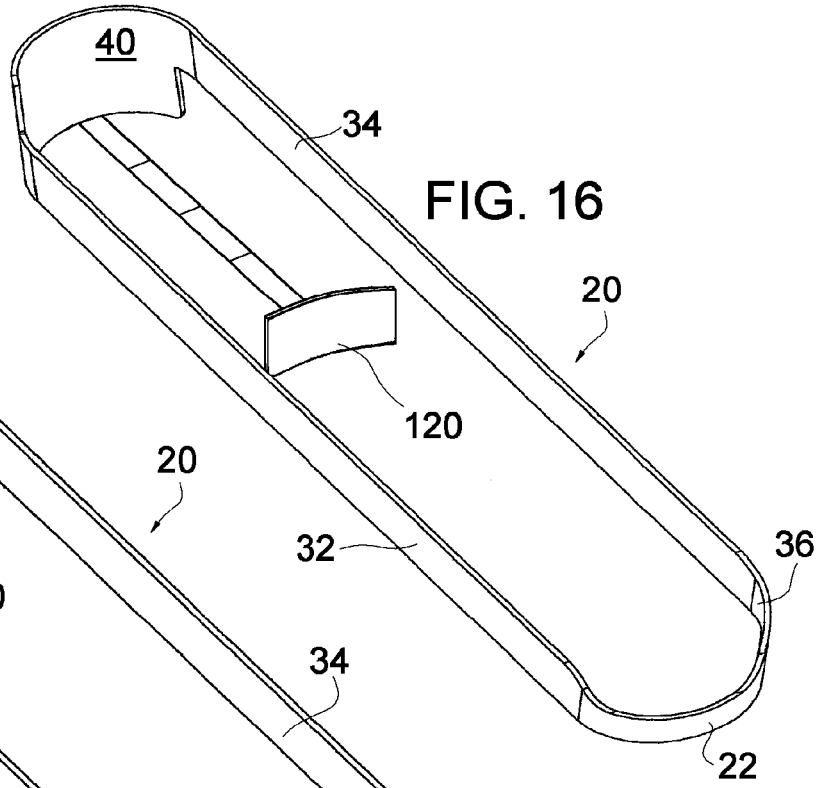
FIG. 16 is a perspective view of an optional adjustable backstop for the shelf allocating and management unit of FIG. 2.

FIG. 16 illustrates an optional adjustable backstop 120 that can be removably attached to the permanent backstop 40 of a unit 20 or a backstop or backstops of a unit 110. This adjustable backstop 120 may be positioned at various distances forward of the permanent backstop 40 in order to shorten the effective depth of the row. This adjustable backstop 120 is useful, for example, in the case where a store prefers to stock less of a slower selling product 14 in a particular product 14 row. The adjustment increments would be equal to the width (or depth) of one individual unit product 14. The adjustable backstop 120 can also be formed as an unattached filler block that is the shape of one or some other multiple of products (or stacked products). Forming this as an adjustable member allows the store manager to vary the number of products in the "fully" stocked row of a unit 110 until he reaches the desired number for the given product 14.

Figure 17:
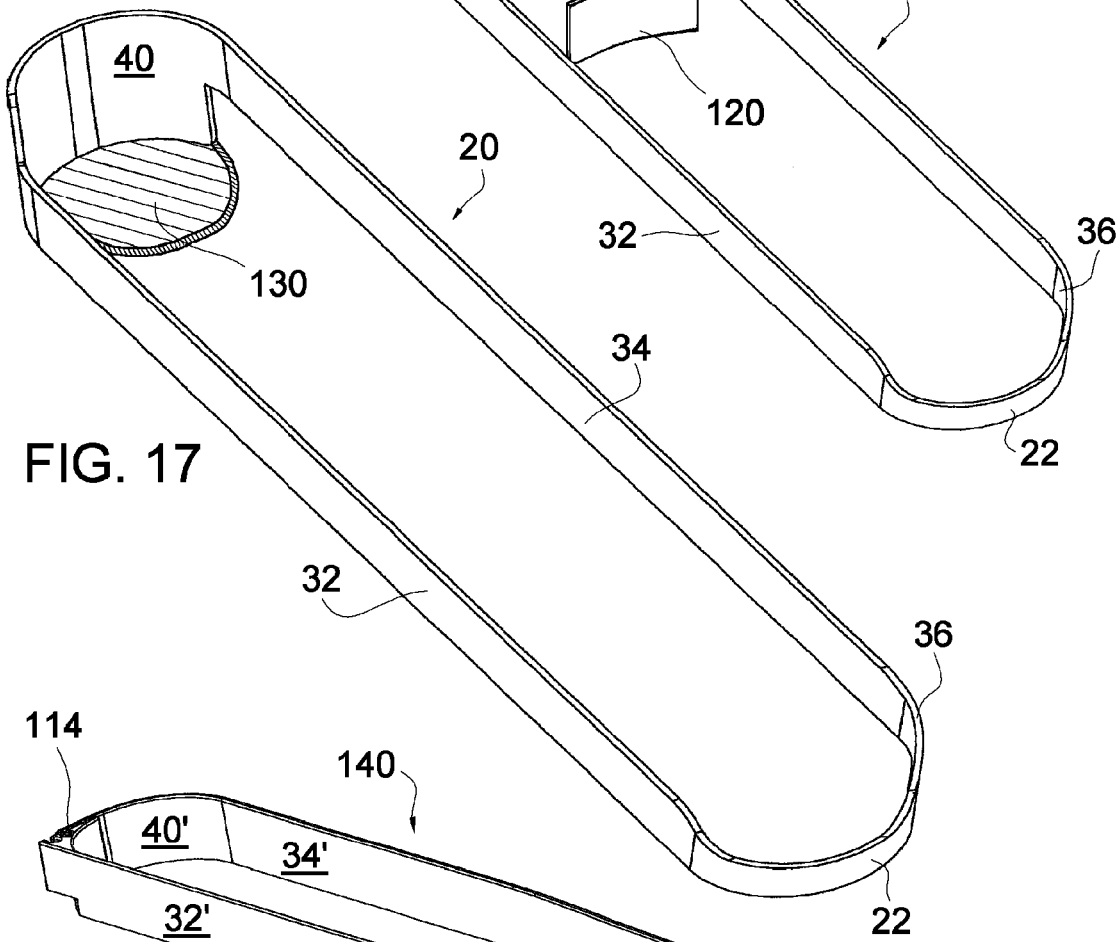
FIG. 17 is a perspective view of an optional platform attachment for the shelf allocating and management unit of FIG. 2.

FIG. 17 illustrates a unit 20 with an optional removably attached platform 130 that extends forward from the base of backstop 40 on a unit 20 or unit 110. This platform 130 corresponds in size to the footprint of one individual product 14 such that one individual product 14 can rest on the platform and thereby serve as a weight to help prevent the unit 20 or unit 110 from being unintentionally moved out of position. The use of the product as a counterweight may be a more economical manner of adding a securing mechanism. The platform 130 still maintains the open bottom structure of the unit 20 or unit 110 as it only supports a single product 14 (or set of stacked products).

Figure 18:
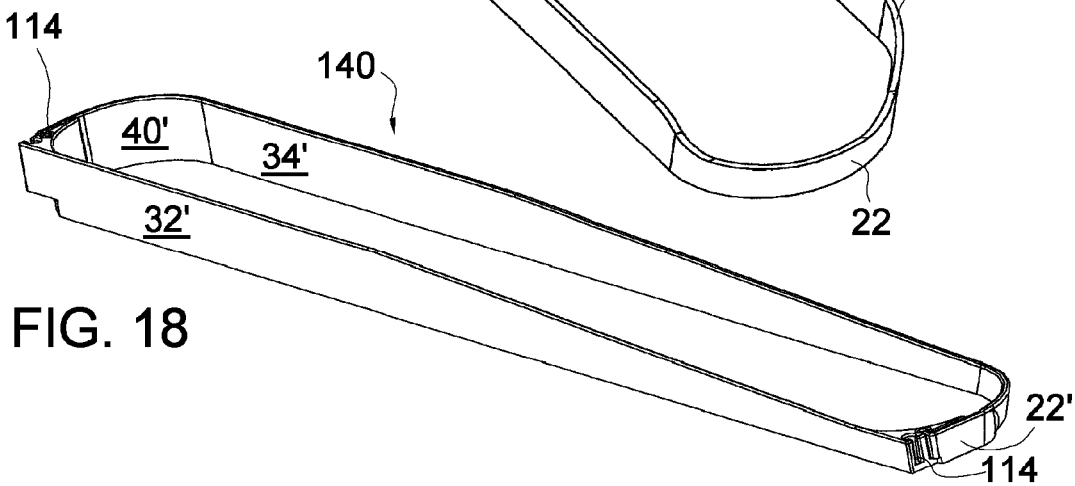
FIG. 18 is a perspective view of a modified version of the shelf allocating and management unit of FIG. 2 that is width-adjustable and has modified dividers that stack together laterally.

FIG. 18 illustrates a unit 140 with laterally stacking dividers that is adjustable in width to accommodate products 14 of varying widths. In such a unit 140 the dividers 32' and 34' stack side-to-side, rather than riding over and under one another when two units 140 are positioned side-by-side, so that two divider thicknesses are presented when two units 140 are positioned laterally side by side. Such a unit 140, which is simple in design, would be useful in those sections of a store where lateral shelf space is somewhat less scarce (or where the lateral length of the shelf 12 is such that the added loss of space through adjacent dividers 32' and 34' does not accumulate to a loss of product facings in the shelf 12). One such use may be in the produce or meat areas, where the products 14 to be displayed are of varying widths.

Figure 19:
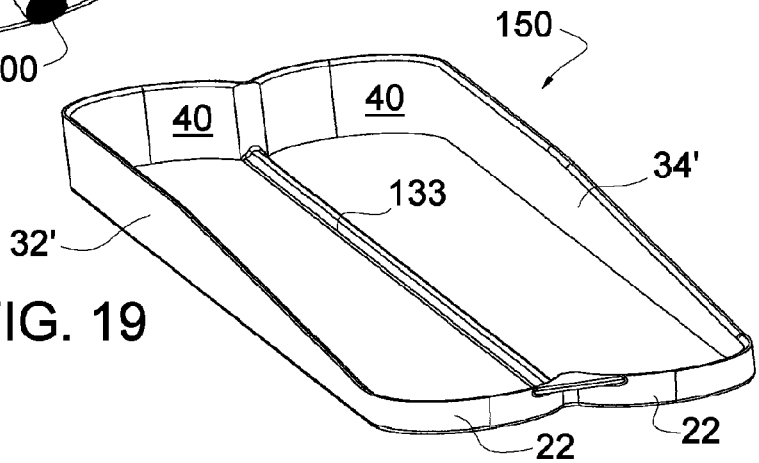
FIG. 19 is a perspective view of a modified version of the shelf allocating and management unit of FIG. 2 with modified dividers that stack together laterally in which two or more product rows may be positioned.

FIG. 19 illustrates a unit 150 with laterally stacking dividers 32' and 34' in which two or more rows of products 14 may be positioned. In such a unit 150 the dividers 32' and 34', rather than riding over and under one another when two units 150 are positioned side-by-side, stack laterally side-to-side so that two divider thicknesses are presented when two units 150 are positioned side by side. Such a unit with laterally stacking dividers that can hold two or more product rows would be useful in merchandising a broad display of products nearly identical in width, and where the loss of space from the accumulation of laterally adjacent dividers 32' and 34' is not considered detrimental.

Figure 20:
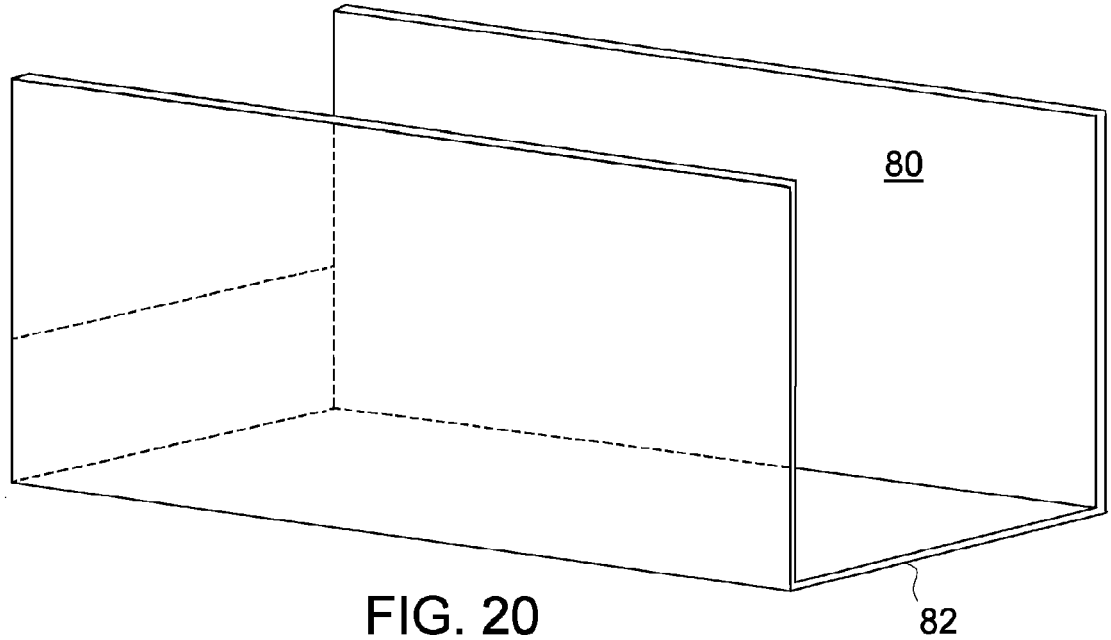
FIG. 20 is a perspective view of a product resetting tool for use with the shelf allocation and management system of FIG. 1.

Another key feature of the system 10 is the ease of product 14 resets than can be accomplished. FIG. 20 illustrates a product resetting tool 80 for use with the shelf allocation and management system 10 of the present invention. The tool 80 provides a sleeve into which a unit 20, 110, 140 or 150 with associated products 14 may be pulled. The sleeve of tool 80 has an open end 82 that can be positioned adjacent the shelf 12 and one or more product rows within unit 20, 110, 140 or 150 advanced therein. The product row(s) is then transported to the new location, the tool 80 is placed adjacent the new shelf location, unit 20, 110, 140 or 150 is slid onto the shelf 12 moving the row(s) of products.

Tool 80 may be wide enough so that multiple units 20, 110, 140 or 150 and multiple product rows may be moved at once. The tool 80 may be a foldable unit for easy storage, such as storing beneath a shelf 12 with the products 14 and system 10 however a non-foldable rigid sleeve construction will ease the use of the tool 80 during resetting operation. Only a single tool 80 need be used for the system 10. The sleeve is formed to accommodate the widest unit 20, 110, 140 or 150, or multiples thereof of the systems. The sides of the sleeve may be branded with instructions for the operator if desired. Preferably, particularly for rigid sleeve construction of the tool 80, the tool 80 is formed of a bright eye-catching color or pattern so that it is easily spotted from its storage location. The tool 80 will be a valuable asset for resets, but will be used somewhat infrequently (depending upon the retail outlet) and may not be used with every shift.

The various features of the present invention can form improved shelf management systems outside of the specific illustrated embodiments. For example the vertically aligned side dividers 32 and 34 of the present invention can yield improved shelf management systems when applied to spring biased backstops of the prior art, or in other systems where a moveable backstop is separated from the sidewalls (e.g. stationary sidewalls). Consequently further embodiments of the present invention include forming the shelf management system with stationary sidewalls or dividers where the stationary dividers of adjacent units are vertically aligned as with the dividers 32 and 34 illustrated in the embodiments discussed above. The construction of the vertically aligned stationary sidewalls 32 and 34 in such embodiments need not accommodate sliding moving dividers, making the construction less complex and easily accommodating interlocking of the dividers. Using the over/under divider alignment of the present invention in stationary divider systems would allow other types of shelf management systems to reduce the amount of lateral shelf space that is occupied by the system and increase the amount of usable space.

It is understood, therefore, that this invention is not limited to the particular embodiments disclosed, but it is intended to cover modifications that are within the spirit and scope of the invention, as defined by the appended claims and equivalents thereto.

What is claimed is:

1. A manual open bottom shelf allocation and management system for allocating shelf space among rows of products and for moving the rows of products toward the front of the shelf, the system comprises:

a plurality of adjacent shelf allocating and managing units, each unit associated with at least one row of products, wherein each unit includes a backstop generally spaced from the front of the shelf adapted to be positioned behind the at least one row of products associated with the unit, a pair of side dividers including a lower side divider and an upper side divider coupled to and extending away from backstop defining an open bottom adjacent the shelf, wherein the at least one row of products associated with the unit may be positioned on the shelf between the side dividers, and wherein the side dividers and backstop of each unit are manually movable integrally as a single unit in a direction extending between the front of the shelf and the back of the shelf substantially perpendicular to the lateral length of the shelf whereby each unit is adapted to advance the at least one row of products associated with the unit toward the front of the shelf, and wherein the side dividers provide for lateral support for the products adjacent the dividers, at least when a side divider is coupled with a side divider of an adjacent unit, and wherein one side divider of each of two adjacent units are in vertical stacking alignment with one another such that the spaces between the side dividers of each of the adjacent units which accommodate the rows of products associated with those units are separated by a distance equal to the thickness of only one side divider.

2. The manual open bottom shelf allocation and management system according to claim 1 further including a width adjusting mechanism allowing the spacing between the pairs of side dividers to be adjusted to accommodate the width of the products, wherein the width adjustment mechanism will secure the side dividers in a plurality of selected relative positions.

3. The manual open bottom shelf allocation and management system according to claim 1 further including a stabilizing element including at least one of counterweight mechanism coupled to the backstop and at least one magnet within each unit to assist in holding the unit in position on metal shelves.

4. The manual open bottom shelf allocation and management system according to claim 1 further including a label holder attached to a front end of at least one unit.

5. The manual open bottom shelf allocation and management system according to claim 1 further including a product resetting tool including a sleeve with at least one open end configured to receive at least one row of products therein.

6. The manual open bottom shelf allocation and management system according to claim 1 further including a unit arresting member associated with at least one unit which can prevent the associated unit from being moved forward, wherein the unit arresting member includes one of a stop or a latch, wherein the stop is coupled to the shelf whereby the unit is prevented from being moved forward to advance the product until the unit is lifted to a position to clear the stop, and wherein the latch is coupled to the shelf in front of at least one unit whereby the unit is prevented from being moved forward to advance the product until the latch is released.

7. The manual open bottom shelf allocation and management system according to claim 1 further including an adjustable backstop that can selectively decrease the number of products associated with one full row within a unit.

8. The manual open bottom shelf allocation and management system according to claim 1 wherein at least an upper side divider's height decreases toward a front end of the unit.

9. The manual open bottom shelf allocation and management system according to claim 1 wherein the side dividers of two adjoining units are in vertical alignment with one another and include cooperating elements to maintain them in vertical alignment.

10. A manual open bottom shelf allocation and management system for allocating shelf space among rows of products and for moving the rows of products toward the front of the shelf, the system comprises:

a plurality of adjacent shelf allocating and managing units, each unit associated with at least one row of products, wherein each unit includes a backstop generally configured to be spaced from front of the shelf and adapted to be positioned behind the at least one row of products associated with the unit, a pair of side dividers including a lower side divider and an upper side divider coupled to and extending away from the backstop defining an open bottom adjacent the shelf, wherein the at least one row of products associated with the unit may be positioned on the shelf between the side dividers, and wherein the side dividers and backstop of each unit are manually movable integrally as a single unit in a direction extending substantially between the front and the back of the shelf substantially perpendicular to the lateral length of the shelf whereby each unit is adapted to advance the at least one row of products associated with the unit toward the front of the shelf, wherein one side dividers of each of two adjacent units are in vertical stacking alignment with one another such that the spaces between the side dividers of adjacent units which accommodate the rows of products associated with those units are separated by a distance equal to the thickness of only one side divider, and a width adjusting mechanism allowing the spacing between the pair of side dividers to be adjusted to accommodate the width of the products, wherein the width adjustment mechanism will secure the side dividers in a plurality of selected relative positions.

11. The manual open bottom shelf allocation and management system according to claim 10 wherein the side dividers provide for lateral support for the products, at least when a side divider is coupled with a side divider of an adjacent unit.

12. The manual open bottom shelf allocation and management system according to claim 10 wherein each unit accommodates a plurality of rows of products.

13. A manual open bottom shelf allocation and management system for allocating shelf space among rows of products and for moving the rows of products toward the front of the shelf, the system comprises:

a plurality of adjacent shelf allocating and managing units, wherein each unit is associated with a plurality of rows of products and each unit includes a front adapted to be in front of the rows of products associated with the unit near a front edge of the shelf, a backstop spaced from the front adapted to be positioned behind the rows of products associated with the unit, a pair of side dividers including a lower side divider and an upper side divider extending away from the front to the backstop defining an open bottom adjacent the shelf, wherein a plurality of rows of products associated with the unit may be positioned on the shelf between the side dividers, and wherein each unit is manually movable in a direction extending between the front and the back of the shelf whereby the unit is adapted to advance the plurality of rows of products between the side dividers toward the front of the shelf, wherein one side divider of each of two adjacent units are in vertical stacking alignment with one another such that the spaces between the side dividers of adjacent units which accommodate the rows of products associated with those units are separated by a distance equal to the thickness of only one side divider, and at least one middle divider laterally spaced from the side dividers and extending away from the front to the backstop between the rows of products.

14. The manual open bottom shelf allocation and management system according to claim 13 wherein the side dividers provide for substantive lateral support for the products, at least when a side divider is coupled with a side divider of an adjacent unit.

15. The manual open bottom shelf allocation and management system according to claim 13 further including at least one width adjusting mechanism allowing the spacing between at least one side divider and a middle divider to be adjusted to accommodate the width of the products, wherein the width adjustment mechanism will secure the at least one side divider in a plurality of selected positions relative to the middle divider.

16. The manual open bottom shelf allocation and management system according to claim 13 wherein each shelf allocating and managing unit has a single middle divider and is configured to accommodate exactly two rows of products.

17. A shelf allocation and management system for allocating shelf space among rows of products and for moving the rows of products toward the front of the shelf comprises:

a plurality of adjacent shelf allocating and managing units, each unit associated with at least one row of products, wherein each unit includes a backstop adapted to be positioned behind at least the row of products associated with the unit, wherein each backstop is movable to advance at least one row of products associated with the unit toward the front of the shelf, and a pair of side dividers including a lower side divider and an upper side divider extending along the sides of the at least one row of products associated with the unit, wherein at least one row of products associated with the unit may be positioned on the shelf between the side divider's, wherein the side dividers and backstop of each unit are manually movable integrally as a single unit and wherein the side dividers provide for lateral support for the products adjacent the dividers, wherein one side dividers of each of two adjacent units are in vertical stacking alignment with one another such that the spaces between the side dividers of adjacent units which accommodate the rows of products associated with those units are separated by a distance equal to the thickness of only one side divider.

* * * * *